US005996836A

United States Patent [19]

Betras

[11] Patent Number: 5,996,836

[45] Date of Patent: Dec. 7, 1999

[54] DRINKING CONTAINER AND HOLDER FOR SAME

[75] Inventor: Joe Betras, Spartanburg, S.C.

[73] Assignee: Betras Plastics, Inc., Spartanburg, S.C.

[21] Appl. No.: 08/893,805

[22] Filed: Jul. 11, 1997

[51] Int. Cl.[6] ..... A45F 5/00

[52] U.S. Cl. ..... 220/709; 224/148.4; 224/148.7

[58] Field of Search ..... 224/148.4, 148.7; 220/709

[56] References Cited

U.S. PATENT DOCUMENTS

| | | | |
|---|---|---|---|
| 2,056,947 | 10/1936 | Baechle . | |
| 2,505,641 | 4/1950 | Howe . | |
| 3,140,007 | 7/1964 | Nettleship . | |
| 3,160,304 | 12/1964 | Peacock | 224/148.4 |
| 3,189,072 | 6/1965 | Starr . | |
| 3,276,617 | 10/1966 | Rempt . | |
| 3,335,923 | 8/1967 | Healy . | |
| 3,380,635 | 4/1968 | Stone et al. | 224/148.7 |
| 3,893,583 | 7/1975 | McLaren . | |
| 4,088,250 | 5/1978 | Schaefer | 224/149.7 |
| 4,093,096 | 6/1978 | Augros . | |
| 4,140,235 | 2/1979 | Rausing et al. . | |
| 4,165,814 | 8/1979 | Seel | 220/709 |
| 4,252,256 | 2/1981 | Walsh . | |
| 4,387,822 | 6/1983 | Lynn . | |
| 4,640,855 | 2/1987 | St. Clair . | |
| 4,708,273 | 11/1987 | Grant | 224/148.7 |
| 4,755,342 | 7/1988 | Biermann . | |
| 4,756,857 | 7/1988 | Dezio et al. . | |
| 4,836,396 | 6/1989 | Ancona et al. . | |
| 4,852,781 | 8/1989 | Shurnick et al. | 224/148.4 |
| 4,955,572 | 9/1990 | Simmons | 224/148.4 |
| 5,044,512 | 9/1991 | Giancaspro et al. | 220/709 |
| 5,105,768 | 4/1992 | Johnson . | |
| 5,135,124 | 8/1992 | Wobser . | |
| 5,232,137 | 8/1993 | Deving | 224/148.7 |
| 5,388,712 | 2/1995 | Brody | 220/709 |
| 5,628,417 | 5/1997 | van Halteren . | |
| 5,676,285 | 10/1997 | Vinarsky | 224/148.4 |

FOREIGN PATENT DOCUMENTS

| | | |
|---|---|---|
| 216921 | 1/1961 | Austria . |
| 2086062 | 5/1994 | Canada . |

OTHER PUBLICATIONS

Betras Plastics, Inc. 1996 Custom Imprint Price List brochure; Mar. 1996.

See "Background of the Invention" section in the present application 1996.

*Primary Examiner*—Joseph M. Moy

*Attorney, Agent, or Firm*—Dority & Manning, P.A.

[57] ABSTRACT

The present invention is generally directed to a drinking container having a hollow body attached to a top. The top can include a pair of apertures for receiving opposite ends of a straw. The straw is removable from at least one of the apertures when one desires to drink from the container. The drinking container further includes a securing device that attaches the container to an adjacent structure, such as to one's clothing. When the drinking container is secured to a user's waist, in one embodiment, the straw can have a length sufficient to extend from the container to a user's mouth.

23 Claims, 4 Drawing Sheets

DRINKING CONTAINER AND HOLDER FOR SAME

FIELD OF THE INVENTION

The present invention is generally directed to a drinking container. More particularly, the present invention is directed to a drinking container that is adapted to be secured to an adjacent structure, such as to a person's waist. In one embodiment, when secured to an individual's waist, the container includes a straw that has a length sufficient to extend from the container to the mouth of the individual.

BACKGROUND OF THE INVENTION

In the past, many different types of drinking vessels having various shapes and functions have been proposed and used. One particular type of drinking vessel that is currently very popular is a squeeze bottle. In general, a squeeze bottle refers to a plastic bottle having a snap-on or screw-on type top. The top defines at least one opening for receiving a straw and a vent for allowing a liquid to be drawn up through a straw.

Because squeeze bottles include a top that, to some extent, prevents a drink from spilling out of the bottle, squeeze bottles are particularly well suited for use at outdoor events, such as carnivals, fairs and amusement parks. Squeeze bottles are also very popular at sporting events for use not only by the spectators but also by the athletes.

One particular type of squeeze bottle that has been recently commercialized includes a top containing two raised apertures spaced apart from each other. One of the apertures defines an opening for inserting a straw into the drinking vessel. The other raised aperture, on the other hand, is adapted to engage the drinking end of the straw when not in use. When the drinking end of the straw is engaged by the second aperture, a drink contained within the vessel is prevented from spilling out of the vessel through the straw. The second raised aperture also protects the drinking end of the straw from becoming contaminated or dirty.

In general, squeeze bottles are constructed to contain large amounts of a drink so that the drink can be enjoyed for a substantial period of time without having to refill the vessel. Unfortunately, most squeeze bottles do not include any type of attachment device. Consequently, the bottles must be held continuously during use. Thus, a need exists for a squeeze bottle that includes a device that permits the bottle to be attached to an adjacent structure such as to one's clothing in order to allow the hands of the user to be free during use.

SUMMARY OF THE INVENTION

The present invention recognizes and addresses the foregoing disadvantages, and others of prior art constructions and methods.

Accordingly, it is an object of the present invention to provide an improved drinking container.

Another object of the present invention is to provide a drinking container that includes a securing device for securing the container to an adjacent structure.

Still another object of the present invention is to provide a drinking container adapted to be secured to an adjacent structure that includes a straw having a length sufficient to extend from the container when attached to an adjacent structure to a user's mouth.

It is another object of the present invention to provide a drinking container having a wide top portion that makes it easy to fill the container with a liquid and with ice.

These and other objects of the present invention are achieved by providing a drinking container including a contoured shaped body having a base portion and a top portion. A top is removably secured to the top portion of the body. The top defines at least one aperture adapted to receive a straw.

In accordance with the present invention, the drinking container further includes a securing device for securing the body of the container to an adjacent structure. The securing device includes a clip member connected to a retaining ring. The retaining ring defines an opening for receiving the contoured shaped body therethrough. The retaining ring is configured to engage the top portion of the body when the drinking container is secured to an adjacent structure.

In one embodiment, the body of the container can be cylindrical and can include a slender neck portion positioned between the base portion and the top portion. The opening defined by the retaining ring can have a size that is slightly larger than the perimeter of the base portion but smaller than the perimeter of the top portion. In this configuration, the retaining ring can be slid over the base portion of the body and adjacent to the top portion for engaging the top portion when the drinking container is secured to an adjacent structure.

The top of the drinking container can include two apertures for receiving opposite ends of a straw. The apertures can form a liquid tight tension fit with the straw to prevent a liquid contained within the container from spilling when the straw is not in use. When the drinking container is secured to an adjacent structure, the straw is long enough to extend from the container to a user's mouth. For instance, in one embodiment, the straw has a length of at least 24 inches, and particularly from about 28 inches to about 36 inches.

As described above, the securing device includes a retaining ring connected to a clip member. Specifically, the clip member can be hingedly connected to the retaining ring. The clip member can include a clamping arm spaced apart from a base plate. When attached to an adjacent structure, such as one's clothing, the adjacent structure can be placed between the clamping arm and the base plate.

These and other objects of the present invention are also achieved by providing a drinking container having a hollow body defining a chamber for receiving a liquid. A top is removably secured to the hollow body. The top defines a first aperture and a second aperture.

The drinking container includes a securing device configured to secure the hollow body to an adjacent structure. A straw is also included having a first end and a second end. The first end of the straw is received within the first aperture defined by the top, while the second end of the straw is removably received within the second aperture. The straw has a length of at least 24 inches.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
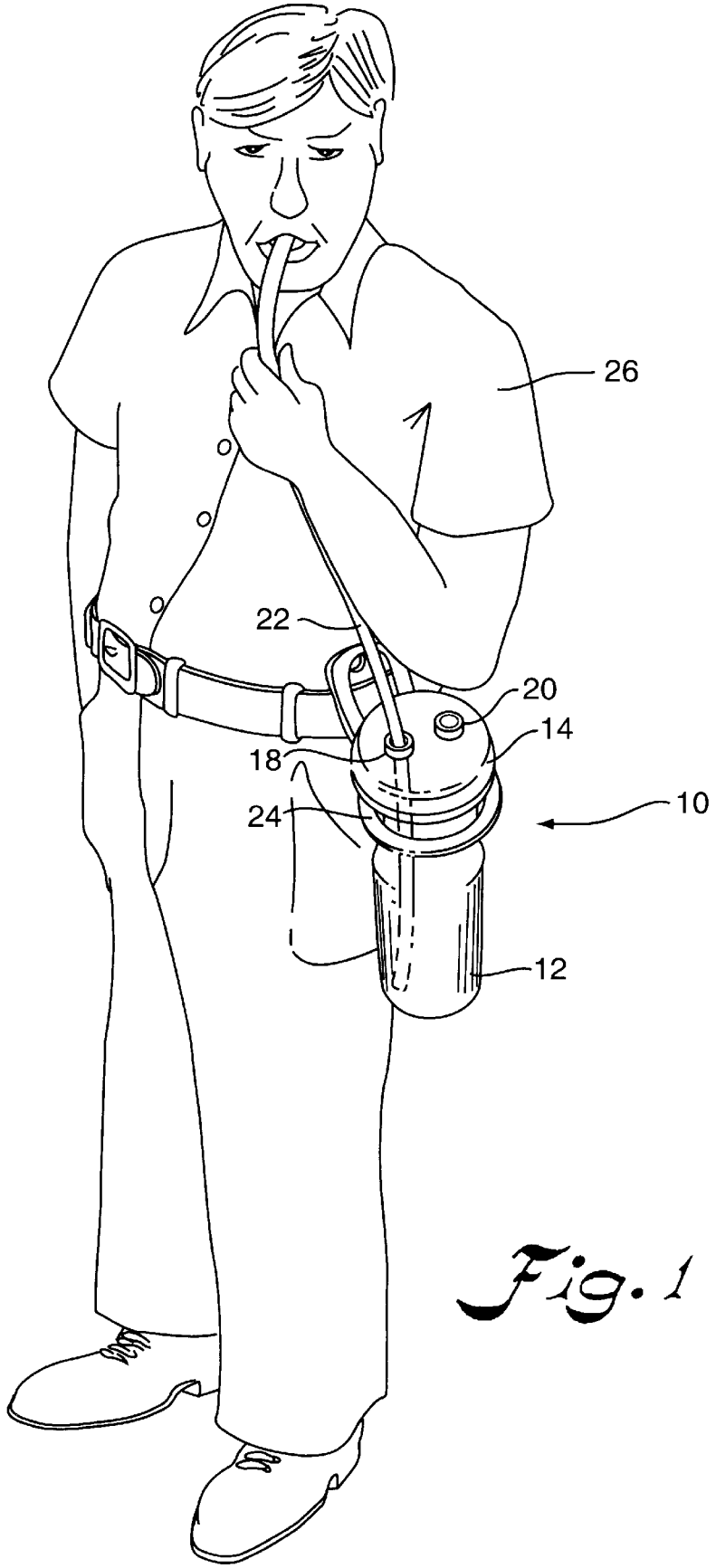
FIG. 1 is a perspective view of one embodiment of a drinking container made in accordance with the present invention secured to a user's hip.

Repeat use of reference characters in the present specification and drawings is intended to represent same or analogous features or elements of the invention.

DETAILED DESCRIPTION OF PREFERRED EMBODIMENTS

It is to be understood by one or ordinary skill in the art that the present discussion is a description of exemplary embodiments only, and is not intended as limiting the broader aspects of the present invention, which broader aspects are embodied in the exemplary construction.

In general, the present invention is directed to a drinking container having a hollow body that is attached to a top. The top includes at least one aperture for receiving a straw. In one embodiment, the top includes a first aperture for inserting one end of the straw into the drinking container and a second aperture for receiving the opposite end of the straw, when the straw is not in use. Of particular advantage, the drinking container also includes a securing device for securing the container to an adjacent structure, such as to the clothing of a user. Once the drinking container is attached to an adjacent structure, the straw can be designed to extend from the container to a user's mouth, so that the container does not have to be handled in order for an individual to take a drink.

Figure 2:
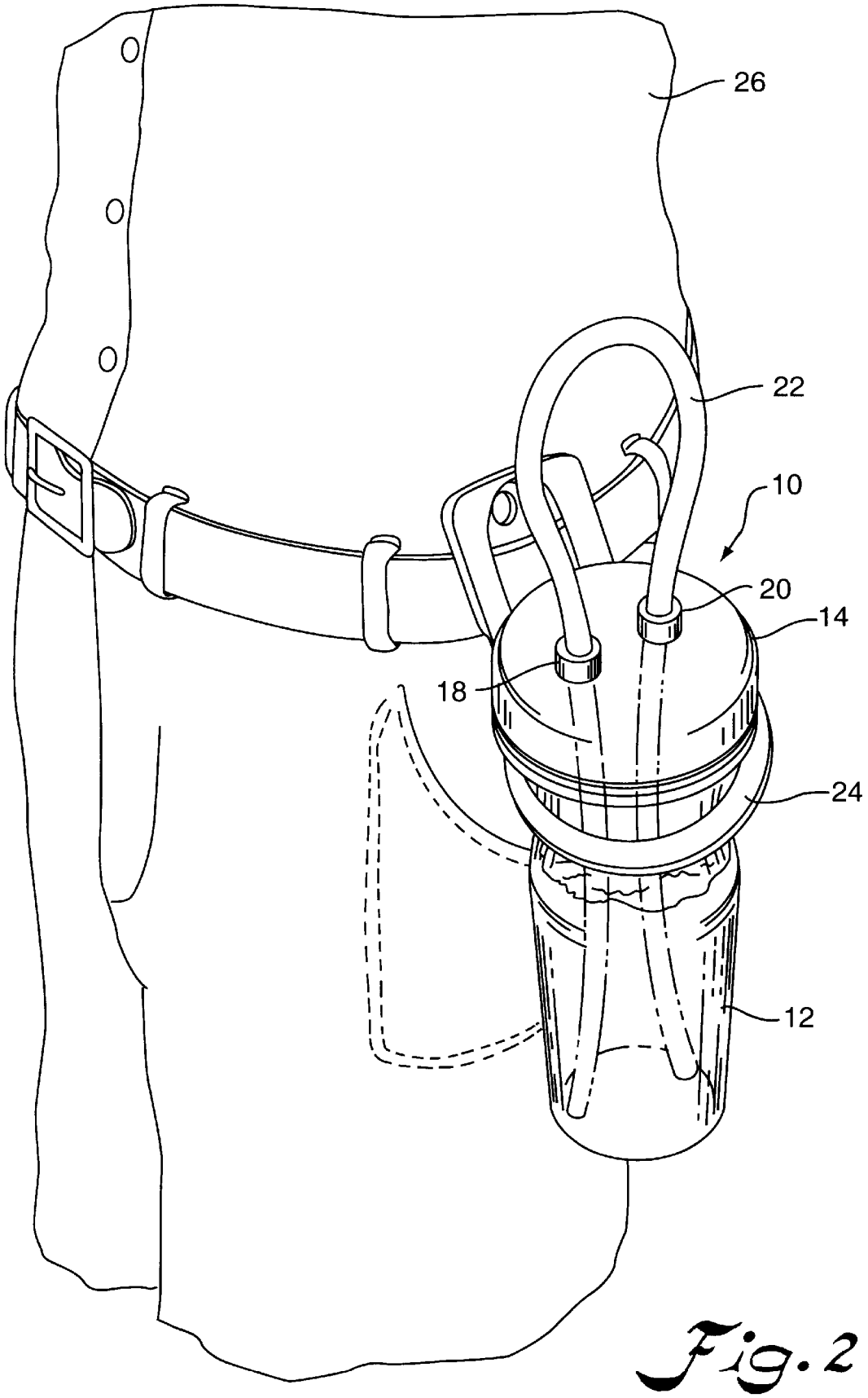
FIG. 2 is a perspective view of the drinking container illustrated in FIG. 1 shown more clearly attached to a user's belt.
Figure 3:
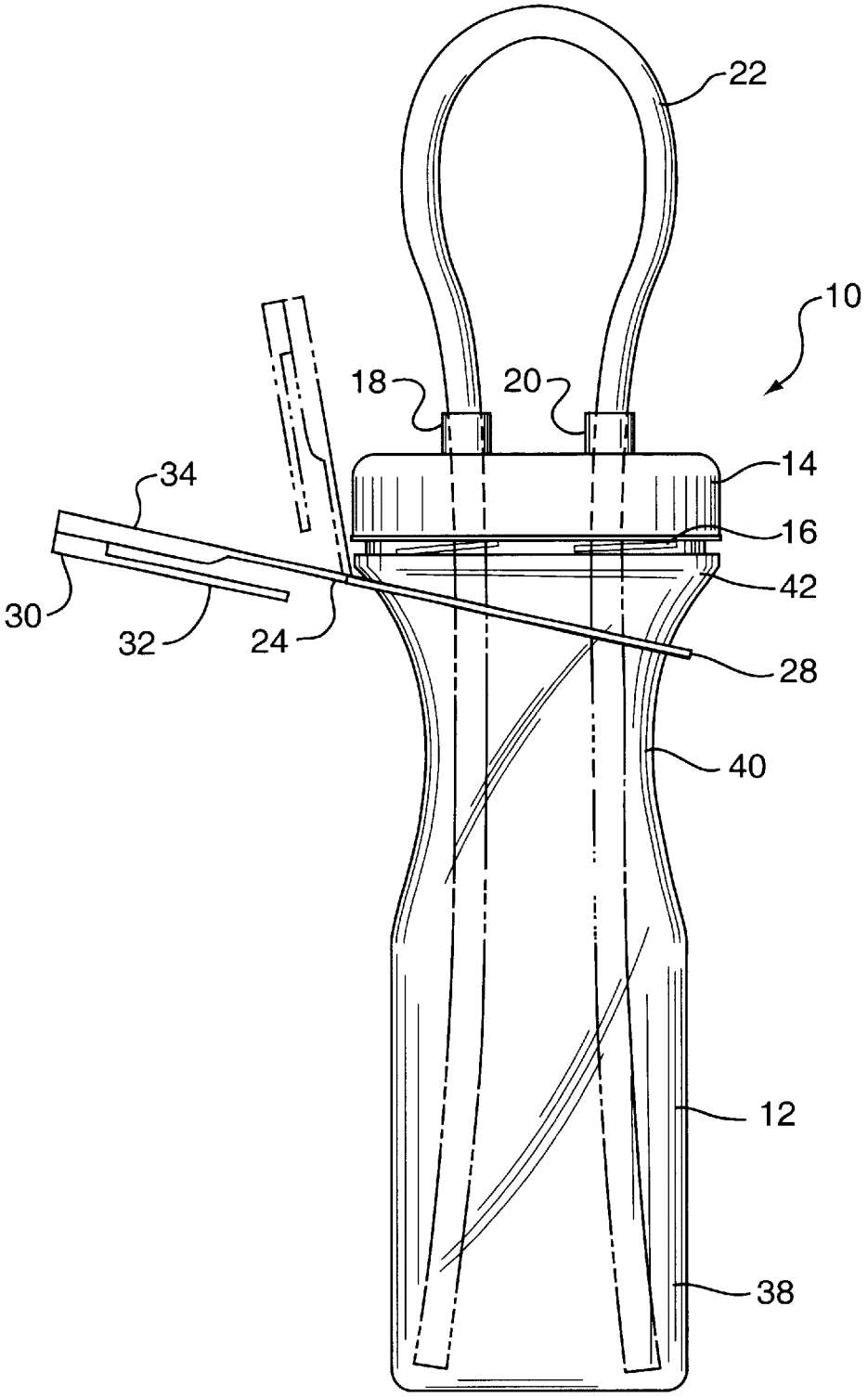
FIG. 3 is a side view of the drinking container illustrated in FIGS. 1 and 2.

For instance, referring to FIGS. 1–3, one embodiment of a drinking container generally 10 made in accordance with the present invention is illustrated. Drinking container 10 includes a body 12 for containing a drink or refreshment. A top 14 is connected to body 12. Top 14 can be screwed onto body 12 using threads 16 as shown in FIG. 3 or, alternatively, can include a snap-on arrangement.

Top 14, in this embodiment, includes a pair of raised apertures 18 and 20 which are adapted to received opposite ends of a straw 22. Apertures 18 and 20 form a liquid tight, tension fit with straw 22. Thus, when straw 22 is not in use and both ends of the straw are received within apertures 18 and 20, drinking container 10 becomes a sealed container for preventing the drink or refreshment from being spilled. Further, when straw 22 is placed in both apertures 18 and 20, the drinking end of the straw remains protected from becoming dirty or otherwise contaminated.

As shown in FIG. 1, aperture 20 of top 14 should be designed to allow the drinking end of straw 22 to be inserted into drinking container 10 and removed when desired. The opposite end of straw 22, on the other hand, can likewise be removable from aperture 18 or can be permanently affixed to aperture 18.

As shown particularly in FIGS. 1 and 2, drinking container 10 also includes a securing device 24 which allows drinking container 10 to be secured to an adjacent structure. In particular, securing device 24 is well adapted to securing drinking container 10 to the clothing of a user 26, such as to a user's belt. Through the use of securing device 24, drinking container 10 can be carried hands free, which is especially convenient at sporting events and various outdoor events, such as festivals, fairs and carnivals. For instance, drinking container 10 of the present invention is particularly well suited for use by video game enthusiasts, who can now play a coin operated video game without having to place their drink on the ground or on the gaming machine itself.

Figure 4:
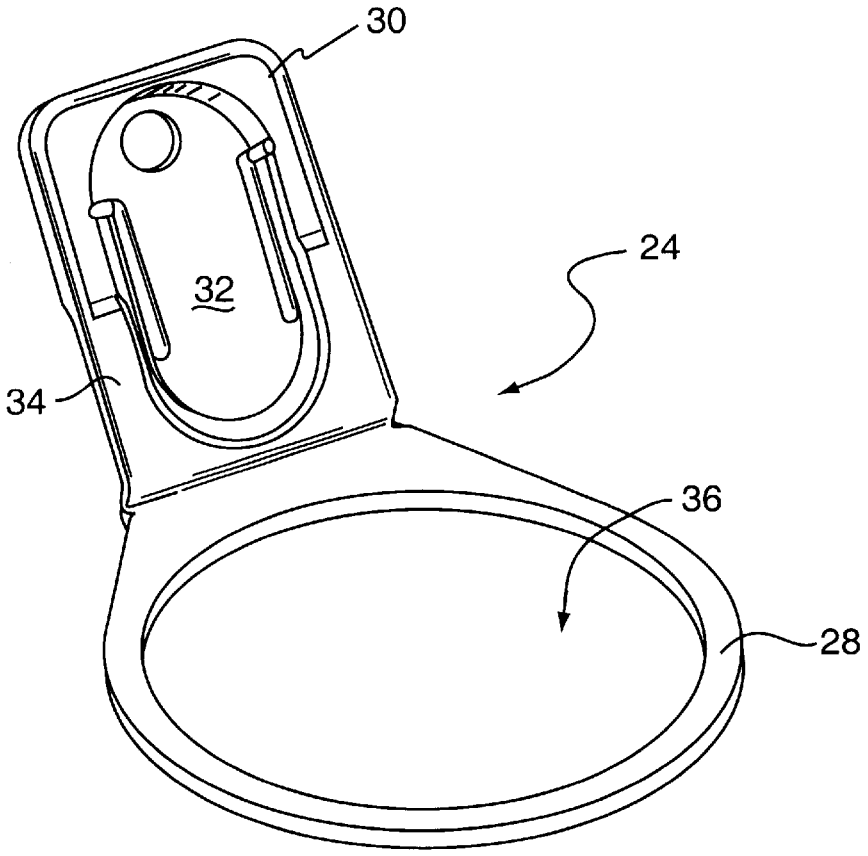
FIG. 4 is a perspective view of one embodiment of a securing device for securing the drinking container of the present invention to an adjacent structure.

Referring to FIG. 4, securing device 24 is shown in more detail. Securing device 24 includes a retaining ring 28 connected to a clip member 30. As shown in FIG. 3, preferably retaining ring 28 is hingedly attached to clip member 30 so that securing device 24 can be attached to various different types of adjacent structures.

In the embodiment shown in FIG. 4, clip 30 includes a clamping arm 32 spaced apart from a base plate 34. In this configuration, when securing device 24 is attached to an adjacent structure, the adjacent structure can be placed between clamping arm 32 and base plate 34. This clip arrangement is particularly well suited for attachment to clothing as shown in FIGS. 1 and 2. Depending upon the application, however, any suitable type of attachment structure may be included. For instance, clip member 30 can be designed to be attached to, besides clothing, a railing, a car door, or to a desk.

Retaining ring 28, on the other hand, defines an opening 36 which is for engaging body 12 of drinking container 10. As shown in FIGS. 1–3, retaining ring 28, in one embodiment, can be adapted to be slid over body 12 for engaging the body of the container. Alternatively, however, retaining ring 28 can be directly affixed to body 12 at any particular location.

One particularly advantageous aspect of the present invention relates to the size of straw 22. As shown particularly in FIG. 1, in one preferred embodiment, straw 22 has a length sufficient to extend from drinking container 10 when secured to an adjacent structure, such as to one's waist, to an individual's mouth. In this manner, the drink or refreshment contained in drinking container 10 can be enjoyed without having to remove the drinking container from the adjacent structure. Further, in this arrangement, the drink or refreshment can be enjoyed without tying up the hands of user 26.

In the past, most drinking vessels were made with straws having a length of about 16 inches or less. Straw 22 of the present invention, however, in one embodiment, can have a length of at least 24 inches, and particularly from about 24 inches to about 44 inches. More particularly, a straw that has been found to be well suited for use by all sizes of individuals when drinking container 10 is attached to one's waist, has a length of from about 28 inches to about 36 inches. For instance, in one preferred embodiment straw 22 can have a length of from about 30 inches to about 32 inches. The actual length of straw 22, however, will depend upon the particular application.

Referring to FIG. 3, one particularly preferred shape of drinking container 10 made in accordance with the present invention will now be described in detail. As shown, body 12 of drinking container 10 includes a base portion 38, a slender neck portion 40, and a wide top portion 42. Although body 12 can have any geometrical shape, drinking container 10 as shown in FIG. 3 is cylindrical.

In the embodiment illustrated in FIG. 3, base portion 38 of body 12 has a circumference or size that is smaller than top portion 42. In this manner, retaining ring 28 of securing device 24 can be slid over base portion 34 in order to engage top portion 42 when attached to an adjacent structure. In other words, opening 36 of retaining ring 28 is large enough to fit over base portion 38 but is not large enough to fit over top portion 42. In this configuration, securing device 24 engages top portion 42 which has been found to provide various benefits. For instance, when drinking container 10 is filled with a liquid, it is preferred that the container be held toward the top to prevent the container from rotating and tipping over when being jostled.

In the above-described configuration as shown in FIG. 3, top portion 42 forms the widest part of body 12. It is has been unexpectedly discovered that by having a wide top portion, drinking container 10 offers other advantages and benefits over many prior art bottles. For instance, it has been discovered that since drinking container 10 has a wide mouth, it is much easier to fill the container with a liquid and especially with ice. Most prior art drinking vessels are made with much smaller mouths. Many difficulties have been experienced in the past in attempting to get ice in these containers, especially in situations where the ice is in cubes and one is trying to fill the container as quickly as possible. Similar problems have not been experienced when using the drinking container of the present invention.

Besides base portion 38 and top portion 42, body 12 as described above also includes slender neck portion 40. Neck portion 40 is provided for two separate reasons. First, neck portion 40 provides a place on the container where it can be easily held with one's hand.

Neck portion 40 also works in conjunction with retaining ring 28 of securing device 24 when the securing device is used to attach the container to an adjacent structure. In particular, within neck portion 40, retaining ring 28 is free to move about. When securing device 24 is attached to an adjacent structure, retaining ring 28 finds its center on neck portion 40 and allows the bottle to hang properly. For instance, as shown in FIGS. 2 and 3, retaining ring 28 will typically engage a portion of top portion 42 on one side of container 10, while on the other side of the container the relating ring will rest upon neck portion 40. When suspended from a user's waist in this arrangement, drinking container 10 does not have a tendency to push against the user's body, but instead tends to hang in a more vertical position.

Drinking container 10 of the present invention can be made from various materials, including glass or plastics. Preferably, however, container 10 is constructed by blow molding a plastic material. If desired, the container can be adapted to receive an emblem or to be screenprinted with a particular design.

In most applications, drinking container 10 will be adapted to contain from about 10 ounces to about 32 ounces of a liquid. Merely for exemplary purposes, the following are particular dimensions of one embodiment of a drinking container made in accordance with the present invention, similar to the container shown in FIG. 3. It should be understood, however, that the drinking container of the present invention can assume many different shapes and variations.

TABLE 1

Exemplary Dimensions of the Drinking Container Illustrated in FIG. 3

| | 10 oz Container Inches | 32 oz Container Inches |
|---|---|---|
| Height | 7.08 | 10.44 |
| Height of Body | 6.45 | 9.50 |
| Diameter of Top Portion | 2.53 | 3.75 |
| Diameter of Neck Portion | 1.64 | 2.50 |
| Diameter of Base Portion | 2.16 | 3.19 |
| Diameter of Retaining Ring | 2.25 | 3.25 |

These and other modifications and variations to the present invention may be practiced by those of ordinary skill in the art without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only and is not intended to limit the invention so further described in such appended claims.

What is claimed is:

1. A drinking container comprising:

a hollow body having a base portion and a top portion, said top portion having a wider dimensions than said base portion;

said body further includes a slender neck portion positioned between said base portion and said top portion;

a top removably secured to said top portion of said hollow body, said top defining at least one aperture adapted to receive a straw; and a securing device for securing said body to an adjacent structure, said securing device comprising a clip member connected to a retaining ring, said retaining ring defining an opening for receiving said hollow body therethrough, said retaining ring being configured to engage said top portion of said body when said drinking container is secured to an adjacent structure, said retaining ring having a smaller diameter than said top portion.

2. A drinking container as defined in claim 1, wherein said body is cylindrical.

3. A drinking container as defined in claim 1, wherein said body has a volume of from about 10 ounces to about 32 ounces.

4. A drinking container as defined in claim 1, wherein said top defines a first aperture and a second aperture, said first and second apertures for receiving opposite ends of a straw.

5. A drinking container as defined in claim 4, further comprising a flexible straw having a first end and a second end, said first end of said straw being received within said first aperture, said second end of said straw being removably received within said second aperture, said flexible straw having a length of at least 24 inches.

6. A drinking container as defined in claim 5, wherein said first and second apertures defined by said top form a liquid tight tension fit with said first and second ends of said straw respectively.

7. A drinking container as defined in claim 1, wherein said clip member is hingedly connected to said retaining ring, said clip member comprising a clamping arm spaced apart from a base plate, said clip member being adapted to be secured to an adjacent structure received between said clamping arm and said base plate.

8. A drinking container comprising:

a hollow body defining a chamber for receiving a liquid, said hollow body including a slender neck portion and a top portion, said top portion having a wider dimension than said neck portion;

a top removably secured to said hollow body, said top defining a first aperture and a second aperture;

a securing device configured to secure said hollow body to an adjacent structure, said securing device including a retaining ring for engaging said top portion of said hollow body, said retaining ring having a diameter less than said top portion; and a straw having a first end and a second end, said first end of said straw being received within said first aperture, said second end of said straw being removably received within said second aperture, said straw having a length of at least 24 inches.

9. A drinking container as defined in claim 8, wherein said straw has a length of from about 28 inches to about 44 inches.

10. A drinking container as defined in claim 8, wherein said straw has a length of from about 30 inches to about 32 inches.

11. A drinking container as defined in claim 8, wherein said slender neck portion is spaced between a base portion and said top portion, said top portion having a dimension wider than said base portion.

12. A drinking container as defined in claim 8, wherein said retaining ring is connected to a clip member.

13. A drinking container as defined in claim 11, wherein said securing device comprises a clip member connected to said retaining ring, said retaining ring defining an opening having a size sufficient to receive said base portion of said body therethrough but being insufficient to receive said top portion therethrough, said retaining ring being slidably positioned adjacent to said top portion for engaging said top portion when said drinking container is secured to an adjacent structure.

14. A drinking container as defined in claim 8, wherein said first and second apertures each include a raised wall that forms a liquid tight tension fit with a corresponding end of said straw.

15. A drinking container as defined in claim 8, wherein said hollow body and said top are made from a plastic material.

16. A drinking container comprising:

a cylindrically shaped body having a neck portion spaced between a base portion and a top portion, said top portion having a diameter greater than said base portion, said base portion and said top portion having a diameter greater than said neck portion;

a top removably secured to said top portion of said cylindrically shaped body, said top defining a first aperture and a second aperture; and a flexible straw having a first end and a second end, said first end being received within said first aperture and said second end being received within said second aperture of said top.

17. A drinking container as defined in claim 16, wherein said first and second apertures defined by said top form a liquid tight tension fit with corresponding ends of said straw, and wherein said straw has a length of at least 24 inches.

18. A drinking container as defined in claim 16, further comprising a securing device for securing said drinking container to an adjacent structure, said securing device comprising a clip member connected to a retaining ring, said retaining ring defining an opening for receiving said cylindrically shaped body therethrough, said retaining ring being configured to engage said top portion of said body when said drinking container is secured to an adjacent structure.

19. A drinking container as defined in claim 18, wherein said retaining ring is slidably positioned over said base portion of said body and placed adjacent to said top portion for engaging said top portion when said drinking container is secured to an adjacent structure.

20. A drinking container as defined in claim 16, wherein said neck portion has a gradually sloping surface.

21. A drinking container as defined in claim 16, wherein said top portion has a diameter of at least about 2.5 inches.

22. A drinking container as defined in claim 16, wherein said top portion has a diameter of at least about 3.5 inches.

23. A drinking container as defined in claim 16, wherein said straw has a length of from about 28 inches to about 44 inches.

* * * * *